US010920308B2

(12) United States Patent
Volpe

(10) Patent No.: US 10,920,308 B2
(45) Date of Patent: Feb. 16, 2021

(54) COATING CYLINDER BORES WITHOUT PRIOR ACTIVATION OF THE SURFACE

(71) Applicant: OERLIKON METCO AG, WOHLEN, Wohlen (CH)

(72) Inventor: Flavio Volpe, Wohlen (CH)

(73) Assignee: OERLIKON METCO AG, WOHLEN, Wohlen (CH)

( * ) Notice: Subject to any disclaimer, the term of this patent is extended or adjusted under 35 U.S.C. 154(b) by 0 days.

(21) Appl. No.: 16/316,545

(22) PCT Filed: Jul. 13, 2017

(86) PCT No.: PCT/EP2017/067748
§ 371 (c)(1),
(2) Date: Jan. 9, 2019

(87) PCT Pub. No.: WO2018/011362
PCT Pub. Date: Jan. 18, 2018

(65) Prior Publication Data

US 2019/0292644 A1 Sep. 26, 2019

(30) Foreign Application Priority Data

Jul. 13, 2016 (EP) ..... 16179340

(51) Int. Cl.
*C23C 4/08* (2016.01)
*C23C 4/134* (2016.01)
(Continued)

(52) U.S. Cl.
CPC ..... *C23C 4/08* (2013.01); *C22C 27/04* (2013.01); *C23C 4/134* (2016.01); *C23C 28/021* (2013.01);
(Continued)

(58) Field of Classification Search
CPC ..... C23C 4/08; C23C 4/134; C23C 28/021; C23C 28/028; C22C 27/04; F02F 1/004; F02F 1/18
(Continued)

(56) References Cited

U.S. PATENT DOCUMENTS 2,588,422 A 3/1952 Shepard
4,044,217 A * 8/1977 Otsuki ..... B23K 20/08 219/78.11
(Continued)

FOREIGN PATENT DOCUMENTS

DE 10 2014 011 139 1/2015
WO 2012/122373 9/2012
WO 2015/072945 5/2015

OTHER PUBLICATIONS

Yerembnko et al., "Interaction of the refractory metals with liquid aluminum", Journal of the Less-Common Metals, Elsevier-Sequoia S.A. Lausanne, CH, bd. 50, Nr. 1, XP024344939, ISSN: 0022-5088, DOI: 10.2016/0022-5088(76)90251-4, Nov. 1, 1976, pp. 29-48.
(Continued)

*Primary Examiner* — Lindsay M Low
*Assistant Examiner* — Yi-Kai Wang
(74) *Attorney, Agent, or Firm* — Greenblum & Bernstein, P.L.C.

(57) ABSTRACT

Cylinder of piston-type internal combustion engine includes at least one bore with inner shell formed from a base material. The base material, in a region of the bore, includes a layer system, and a first boundary surface formed between base material and layer system. Layer system includes at least one thermally sprayed layer forming at least partially a shell surface of the bore and acts there as a functional layer. First boundary surface does not include any profiling applied for mechanical activation of the surface apart from surface roughness resulting from manufacture of the bore. The
(Continued)

material of the layer system includes molybdenum and at least one further element in the region of the boundary surface to the base material and is bonded to the base material by a chemical bond. This boundary surface material differs from the material of the functional layer in composition and/or structure.

16 Claims, 2 Drawing Sheets

(51) Int. Cl.

| | |
|---|---|
| ***F02F 1/00*** | (2006.01) |
| ***C23C 28/02*** | (2006.01) |
| ***F02F 1/18*** | (2006.01) |
| ***C22C 27/04*** | (2006.01) |

(52) U.S. Cl.
CPC ..... *C23C 28/028* (2013.01); *F02F 1/004* (2013.01); *F02F 1/18* (2013.01)

(58) Field of Classification Search
USPC ..... 123/668
See application file for complete search history.

(56) References Cited

U.S. PATENT DOCUMENTS

| | | | | |
|---|---|---|---|---|
| 2004/0105939 | A1* | 6/2004 | Haug | C23C 4/18 427/446 |
| 2005/0025896 | A1* | 2/2005 | Grinberg | C23C 4/08 427/446 |
| 2007/0012180 | A1* | 1/2007 | Miyamoto | C23C 24/04 92/171.1 |
| 2010/0162886 | A1* | 7/2010 | Choi | B22D 19/0009 92/169.4 |
| 2014/0199163 | A1* | 7/2014 | Lee | C04B 41/52 415/174.4 |
| 2015/0240741 | A1* | 8/2015 | Scherer | C23C 4/08 92/169.4 |

OTHER PUBLICATIONS

German Search Report/Office Action conducted in counterpart German Appln. No. 16 179 340.1-1603 (dated Jan. 23, 2017) (w/ partial machine translation).

He Limin et al., High-temperature Protective Coating, National Defense Industry Press, 1st ed., 1st printing, pp. 48-49 (Feb. 2012)—included in China Action. Separate copy provided for convenience.

China Search Report/Office Action conducted in counterpart China Appln. No. 201780043504 (dated Oct. 10, 2020) (w/ translation).

* cited by examiner

COATING CYLINDER BORES WITHOUT PRIOR ACTIVATION OF THE SURFACE

The cylinder bores of some piston-type internal combustion engines are provided with a coating, usually by thermal spraying, in order to minimize weight and/or friction and/or wear. In doing so, the fuel and oil consumption is reduced and preferably also the surface of the cylinder bore is made more corrosion-resistant.

However, the adhesion of this layer to the cylinder material is problematic so that the layer runs the risk of flaking off during operation. In order to increase this to the level necessary for the application, the surface of the cylinder bore is usually roughened (activated). Such an activation ensures that a mechanical interlocking is created between the layer and the base material of the cylinder block, i.e. that a form locking is achieved. This pre-machining step of activating the cylinder running surface increases the costs of the coating.

The entanglement between the layer and the base material of the cylinder block achieved by activation improves the adhesion of the layer to the base material and contributes to a long service life of the cylinder. Different techniques can be used to perform the activation. For example, the surface can be roughened by means of corundum jets, by means of a laser, by means of a high-pressure water jet and/or by means of a low-pressure water jet. A further possibility of activation is to provide the surface with a profile with undercuts, for example by means of a cutting process. For example, the dovetail geometry is used here with advantage.

Accordingly, FIG. 1 shows the mechanical interlocking of the spray coating 3 with the base material 1 by activating the base material before coating. According to the state of the art, this improves the adhesion to the base material 1, for example a cylinder bore.

The activation methods described above have, among other things, the disadvantage that they can only be realized with increased production effort. In addition to the increased process time required for the additional step, there are also additional investment costs for the activation tool and/or the machine.

There were already early attempts to avoid surface activation by means of an intermediate layer. For example, Shepard discloses in U.S. Pat. No. 2,588,422 a molybdenum layer as an intermediate layer. This then forms a boundary surface in each case with the base material on the one hand and with the sprayed functional layer on the other hand. Apart from the fact that elemental molybdenum is a very soft material, this approach also poses the problem that it is not possible to improve the adhesion at both boundary surfaces in a satisfactory way.

It is therefore an object of the present invention to indicate a method that allows the thermally sprayed layer to be applied adheringly to the shell of a cylinder bore without the need for activation, in particular mechanical activation, of the surface to be coated.

According to the invention, the object is met by the cylinder according to the invention according to claim 1 and the method according to the invention according to claim 8. Claims 2 to 7 and 9 to 12 relate to further advantageous embodiments of the present invention and claims 13 and 14 relate to the corresponding engine or to its manufacture.

The cylinder comprises at least a bore with an inner shell formed from a base material, wherein in the region of the bore the base material is at least partially provided with a layer system. In this respect, a first boundary surface is formed between the base material and the layer system, wherein the first boundary surface does not comprise any profiling applied for the activation of the surface, in particular no profiling applied for the mechanical activation of the surface, apart from the surface roughness resulting from the manufacture of the bore.

The layer system comprises at least one thermally sprayed layer, in particular a layer thermally sprayed by plasma spraying, preferably a layer thermally sprayed by a rotating plasma gun, and the thermally sprayed layer forms at least partially the shell surface of the bore and can act there as a functional layer. In the following, the functional layer can preferably also be understood as a function layer, particularly preferred as a thermally sprayed function layer.

The core of the method is the application of an adhesive layer directly onto the base material of the cylinder bore shell, whereby the adhesive layer forms a chemical bond at least with the base material. The adhesive layer may comprise the boundary surface material, in particular it may consist of the boundary surface material. The adhesive layer can be composed of the boundary surface material. This means that the adhesion at the boundary surface to the base material is not decisively achieved by mechanical interlocking but essentially by chemical bonding.

The boundary surface material comprises molybdenum (Mo) and at least one further element but in particular may consist essentially of molybdenum and at least one further element, especially the boundary surface material may consist of molybdenum and at least one further element. If in the present description or in the claims the presence of another element is mentioned, this may or may not be present in elementary form but may also be present as a molecule and/or within a chemical compound.

In an embodiment of the invention, the proportion of molybdenum in the boundary surface material, in particular in the adhesive layer, can be in a range from 30 to 90% by weight and the proportion of the further element in the boundary surface material, in particular in the adhesive layer, can be in a range from 70 to 10% by weight, preferably the proportion of molybdenum in the boundary surface material can be in a range from 40 to 80% by weight and the proportion of the further element in the boundary surface material in a range from 60 to 20% by weight, particularly preferably the proportion of molybdenum in the boundary surface material can be in a range from 50 to 70% by weight and the proportion of the further element in the boundary surface material in a range from 50 to 30% by weight. Especially, the proportion of molybdenum in the boundary surface material can be in a range from 55 to 65% by weight or from 58 to 62% by weight or 60% by weight and the proportion of the further element in the boundary surface material can be in a range from 45 to 35% by weight or from 42 to 38% by weight or 40% by weight. The boundary surface material may also comprise a content of impurities such as S and P in the range from 0.01 to 0.2% by weight, preferably 0.01 to 0.1% by weight.

In an embodiment of the invention, the further element and/or the function layer can comprise the following materials, in particular can consist of the following materials:

For the further element and/or the function layer, a material, preferably an iron-based material (hereinafter also referred to as Fe-Base) in the form of a powder, in particular a gas-atomized powder of the following chemical composition can be used:

C=0.4 to 1.5% by weight
Cr=0.2 to 2.5% by weight
Mn=0.2 to 3% by weight
Fe=difference to 100% by weight, in particular, the powder may additionally contain:
S=0.01 to 0.2% by weight
P=0.01 to 0.1% by weight.

Preferably, for the further element and/or the function layer, the Fe-Base in the form of a powder, in particular a gas-atomized powder of the following chemical composition can be used:
C=0.1 to 0.8% by weight
Cr=11 to 18% by weight
Mn=0.1 to 1.5% by weight
Mo=0.1 to 5% by weight
Fe=difference to 100% by weight,
in particular, the powder may additionally contain:
S=0.01 to 0.2% by weight
P=0.01 to 0.1% by weight.

However, the further element and/or the function layer can also be a Fe-Base material with the following chemical composition: Fe0.2C1.4Cr1.4Mn, in particular it can also contain Mo=0.1 to 5% by weight.

The particle size of the powder of the further element and/or the function layer can be in the range of 5 to 25 μm or 10 to 45 μm or 15 to 60 μm.

However, the further element and/or the function layer can also comprise the following materials, in particular they can consist of the following materials:

- Fe-Base+30% Mo—especially Fe0.2C1.4Cr1.4Mn+30% Mo
- MMC=metal matrix composite consisting of Fe-Base and an oxide ceramic, in particular of a tribological oxide ceramic, preferably an oxide ceramic which consists of TiO2 or of Al2O3TiO2 and/or Al2O3ZrO2 and/or Al2O3-ZrO2 alloy systems, and/or the proportion of oxide ceramic in the material used, in particular powder, is 5 to 50% by weight, preferably 35% by weight. Especially, the MMC can be Fe14Cr2Mo and 5 to 50% by weight, preferably 35% by weight of the oxide ceramic.
- All-ceramics such as TiO2 or Cr203
- Cr3C2-25NiCr, in particular Cr3C2-25NiCr and 20% Mo
- AlSi and a ceramic (such as TiO2, ZnO2), in particular AlSi and 20% by weight Mo and a ceramic.

If the present description or the claims refer to an adhesive layer, for example within a layer system, it need not necessarily be formed with a well-defined boundary surface to the other layer(s) of the layer system, unless otherwise defined. For example, this can pass into another layer via a composition gradient, or a well-defined layer can be missing due to boundary surface profiling.

If the present description or the claims refer to the presence of a chemical element, this does not have to be present in elementary form but can also be present within a chemical compound.

According to a preferred first embodiment of the present invention, the material of the adhesive layer is additionally selected such that this material also forms a chemical bond with the material of the thermally sprayed function layer to be applied and adheres to it.

According to another, also preferred, second embodiment, the adhesive layer is designed in such a way that it has a surface roughness, which results in the thermal sprayed function layer to be applied adhering at least mechanically to the adhesive layer in a sufficient extent. For example, a corresponding roughness can be achieved through targeted columnar growth. It is also possible to achieve the roughness of the adhesive layer by means of increased porosity.

FIG. 2 shows an embodiment according to the invention, according to which the adhesion of the sprayed function layer 3 to the base material 1 is ensured without activation of the surface of the base material 1 by chemical bonding between the adhesive layer 5 and the base material 1 and by mechanical and/or chemical bonding between the adhesive layer 5 and the function layer 3.

In an embodiment, the coating of the cylinder bore, in particular the layer system, can be designed in the form of a gradual transition and/or a gradient, in particular in terms of chemical composition and/or structural construction. In this way, there is actually only one layer with gradually changing composition and/or morphology, i.e. a gradual layer, in particular a gradual layer system. A gradual layer, in particular a gradual layer system, can therefore be understood to mean that the gradual layer then comprises material directly at the first boundary surface, which material forms a chemical bond with the surface of the base material of the cylinder, i.e. in particular the material of the adhesive layer, i.e. the boundary surface material. With increasing distance from this surface, i.e. with increasing layer thickness, the coating material then gradually merges into the coating material of the thermal sprayed layer to be actually applied, preferably the function layer.

In an embodiment of the invention, the gradual layer, in particular the gradual layer system, with the gradually changing composition, i.e. the gradual transition and/or the gradient, may comprise the following two variants:

Variant 1

The boundary surface material gradually merges into the material of the functional layer, in particular the function layer, where applies:

Start of the layer having the gradually changing composition at the first boundary surface with 0% by weight material of the function layer and 100% by weight boundary surface material, wherein the boundary surface material may comprise 60% by weight molybdenum and 40% by weight of further element, preferably the boundary surface material may consist of 60% by weight of molybdenum and 40% by weight of Ni5Al. End of the layer having the gradually changing composition with 100% by weight of function layer and 0% by weight of boundary surface material, so that the end of the gradual layer forms at least partially the shell surface of the bore of the cylinder and can act there as function layer.

Variant 2

The boundary surface material may comprise molybdenum and the further element, in particular consisting thereof, wherein the further element preferably corresponds to the material of the function layer, and the boundary surface material gradually merges into the material of the function layer, in particular the adhesive layer merges into the function layer, where applies:

Start of the layer having the gradually changing composition at the first boundary surface with 40% by weight of further element and 50 to 70% by weight, preferably 60% by weight, of molybdenum. End of the layer having the gradually changing composition with 0 to 40% by weight of molybdenum and 60 to 100% by weight of further element corresponding in particular to the material of the function layer, preferably 20 to 40% by weight of molybdenum and 60 to 80% by weight of further element, particularly preferred 30% by weight of molybdenum and 70% by weight of further element, so that the end of the gradual layer at least partially forms the inner shell surface of the bore of the cylinder and can act there as a function layer.

For example, variant 2 may then have the following chemical composition and course:

Example 1

Further element=Fe-Base, in particular function layer=further element=Fe-Base

Start: Fe-Base and 60% by weight of molybdenum, preferably Fe0.2C1.4Cr1.4Mn+60% Mo End: Fe-Base, preferably Fe0.2C1.4Cr1.4Mn Example 2

Further element=Fe-Base, in particular function layer=further element=Fe-Base Start: Fe-Base and 60% by weight of molybdenum, preferably Fe0.2C1.4Cr1.4Mn+60% molybdenum End: Fe-Base and 30% by weight of molybdenum, preferably Fe0.2C1.4Cr1.4Mn+30% molybdenum In an embodiment of the invention, the proportion of the boundary surface material in the gradual layer with the gradually changing composition may preferably decrease linearly or exponentially from the start to the end, especially in variant 1 and/or variant 2, and/or the proportion of the function layer in the layer with the gradually changing composition can preferably increase linearly or exponentially from the start to the end, in particular in variant 1 and/or variant 2.

According to a particularly preferred third embodiment of the present invention, the coating of the cylinder bore is designed in the form of a gradient. Directly at the boundary surface, the coating to be applied then comprises materials, which form a chemical bond with the surface of the base material of the cylinder, i.e. in particular the material of the adhesive layer. With increasing distance from this surface, i.e. with increasing layer thickness, the coating material gradually merges with the coating material of the protective thermal sprayed layer to be actually applied. This could, for example, be realized by a double injection with a temporally decreasing injection of the adhesive layer and/or a temporally increasing injection of the function layer. In this way, there is actually only one layer with gradually changing composition and/or morphology, i.e. a gradual layer, in particular a gradual layer system.

In an embodiment of the invention, the layer with the gradually changing composition, i.e. the gradual transition, i.e. a grading layer, can also be realized by a single injection, where two separate feeds for the material of the adhesive layer and the function layer can be used, in particular two powder conveyors which are brought together in a Y-shaped component.

As an example for such an adhesive layer, a material composition can be given which comprises NiAl and Mo.

In an embodiment of the invention, the boundary surface material may comprise molybdenum and Ni5Al, preferably consisting of molybdenum and Ni5Al. The following Table 1 shows the average adhesive tensile strengths achieved with conventional known activation (mechanical, corundum) and with a boundary surface material consisting of molybdenum and Ni5Al, in particular, the boundary surface material may also consist of molybdenum and Ni5Al and a proportion of impurities in the range from 0.1 to 0.3% by weight.

TABLE 1

Comparison of the adhesive tensile strengths with conventional known activation and with a boundary surface material consisting of molybdenum and Ni5Al.

| Molybdenum proportion of adhesive layer [% by weight] | Ni5Al proportion of adhesive layer [% by weight] | Type of activation/ Adhesive layer | Average adhesive tensile strength [Mpa] |
|---|---|---|---|
| None | None | Activated with corundum | 18.1 |
| None | None | Mechanically activated | 35.2 |
| 30 | 70 | Adhesive layer | 40.8 |
| 40 | 60 | Adhesive layer | 41.5 |
| 60 | 40 | Adhesive layer | 44.0 |
| 70 | 30 | Adhesive layer | 41.0 |
| 90 | 10 | Adhesive layer | 30.0 |

The invention is now represented in detail with reference to an example and with the help of the figures.

Figure 1:
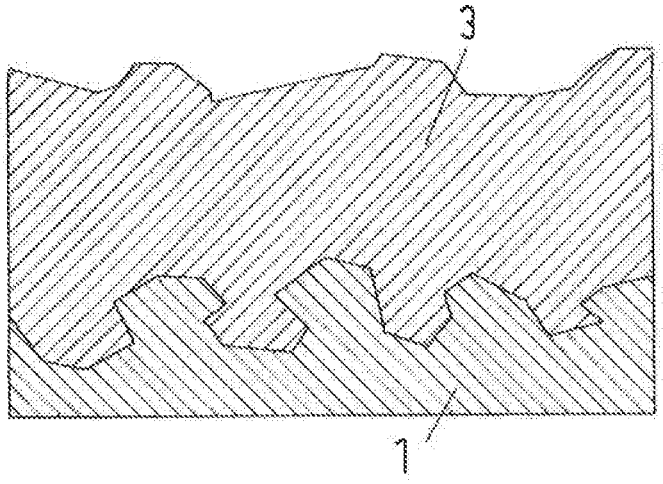
FIG. 1 shows the state of the art up to now
Figure 2:
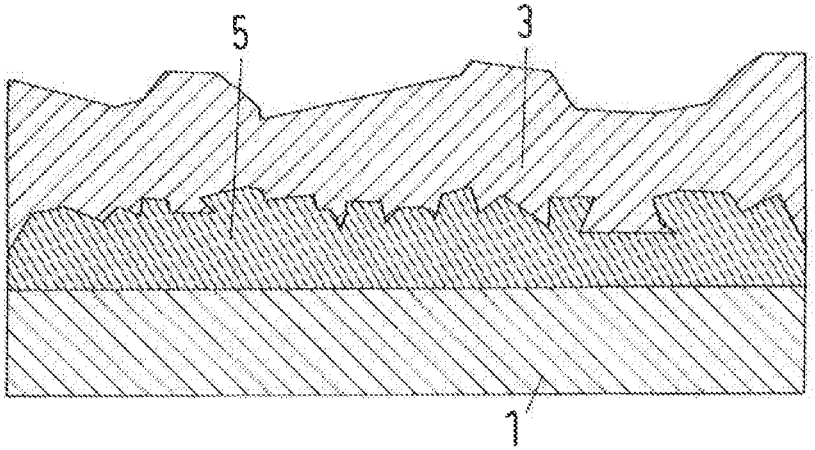
FIG. 2 shows a first embodiment of the present invention.
Figure 3:
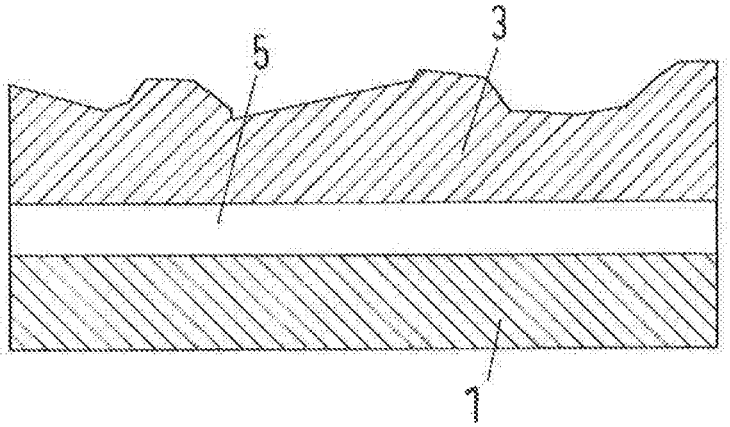
FIG. 3 shows a second embodiment of the present invention.

The example refers to the invention according to the first embodiment. The bore of a cylinder is coated, whereby the base material of the cylinder is an aluminum alloy and the bore has a diameter of 85 mm and the bore is 170 mm deep. This bore is to be coated with an iron-based thermally sprayed coating (95% Fe, 1.5% Cr, 1% Mn, 1% C) with a thickness of 200-300 micrometers. Atmospheric plasma spraying (APS) is to be used as the coating method for thermal spraying. In this case, powdery coating material is continuously melted in a plasma under supply of energy and process gases, atomized in liquid form and then applied to the base material of the cylinder wall inside where it solidifies and forms a closed layer. The plasma gun rotates during the melting process so that the inside of the cylinder wall is evenly coated.

If this layer were simply applied directly to the base material using the method described, it would not adhere sufficiently to the base material. According to the state of the art, the surface of the base material could now be roughened or profiled.

In contrast, in the present embodiment according to the invention a 5-150 micrometer thick adhesive layer of a mixture of molybdenum and nickel-aluminum powder is applied directly to the base material. This material has the advantage that it forms chemical bonds both with the base material and with the actual layer material. At the boundary surface to the base material, chemical compounds of an ionic nature, for example, are formed, and at the boundary surface of the adhesive layer to the coating material, ionic bonds are also formed and, in addition, mechanical interlocking by the rough spray coating occurs. In doing so, a sufficient adhesion at both boundary surfaces is ensured.

The invention claimed is:

1. A cylinder of a piston-type internal combustion engine, comprising:

at least one bore with an inner shell formed from a base material, a layer system at least partially provided on the base material in a region of the bore to form a first boundary surface between the base material and the layer system, wherein the layer system comprises a thermally sprayed layer that at least partially forms a shell surface of the bore to act as a functional layer, wherein the layer system further comprises an adhesive layer including a boundary surface material, in a region of the first boundary surface, that includes molybdenum and at least one further element, the boundary surface material being bonded to the inner shell of the base material, and the inner shell having a surface roughness from the manufacturing of the bore but not profiled to activate the inner shell, by a chemical bond, and wherein the boundary surface material differs from a material of the functional layer in at least one of composition or structure.

2. The cylinder according to claim 1, wherein the layer system is configured for the bonding of the layer system on the bore material.

3. The cylinder according to claim 2, wherein the layer system are configured to at least one of form the chemical bond or to produce a boundary surfaces roughness.

4. The cylinder according to claim 1, wherein the chemical bond between the boundary surface material to the base material is realized by at least one of ionic bonds or covalent bonds.

5. The cylinder according to claim 1, wherein at least one chemical element which corresponds to a chemical element in the base material is present in the boundary surface material.

6. The cylinder according to claim 1, wherein the layer system forms at least partially at least one of: at least one gradient in a chemical composition or structural construction over a layer thickness, starting from the first boundary surface and continuing through the functional layer on the shell surface.

7. The cylinder according to claim 1, wherein at least one chemical element, which corresponds to a chemical element in the functional layer, is present in the boundary surface material.

8. An engine having a cylinder according to claim 1.

9. The cylinder according to claim 3, wherein the at least one of the chemical bonds or the boundary surface roughnesses are formed by at least one of applying the boundary surface material or a gradual transition from the boundary surface material to a material of the functional layer.

10. A method of manufacturing a cylinder for a piston-type internal combustion engine, the method comprising:

forming a bore in a base material, the bore having an inner shell with a surface roughness resulting from manufacture of the bore, applying a layer system to the inner shell of the bore, the layer system comprising an adhesive layer including a boundary surface material at a boundary surface to the base material and a thermally sprayed layer forming a functional layer as a surface of the cylinder, wherein the surface roughness of the inner shell from the manufacturing of the bore is not profiled to activate the surface of the bore for applying the layer system, wherein the boundary surface material comprises molybdenum and at least one further element to form a chemical bond with the base material, and wherein the boundary surface material and a material of the thermally sprayed functional layer differ chemically in at least one of composition or structure.

11. The method according to claim 10, wherein a region comprising the boundary surface material between base material and functional layer is produced as a base layer forming a second boundary surface to the functional layer in such a way that the second boundary surface has structures suitable for mechanical activation such as at least one of porosity, or roughness or columnarity.

12. The method according to claim 10, wherein the layer system is applied completely by thermal spraying.

13. The method according to claim 10, wherein the layer system is formed at least partially as a gradient layer in a direction of layer thickness.

14. The method according to claim 13, wherein, a transition from the boundary surface material to a material of the functional layer is formed as a gradient.

15. A method of manufacturing an engine, wherein the method comprises the manufacturing a cylinder according to claim 10.

16. The method according to claim 10, further comprising forming a second boundary surface on the boundary surface material for bonding with the functional layer, wherein the second boundary surface comprises at least one of a porosity, roughness or columnarity for mechanical activation.

* * * * *